US008457339B2

(12) United States Patent
Li

(10) Patent No.: US 8,457,339 B2
(45) Date of Patent: Jun. 4, 2013

(54) LOUDSPEAKER ASSEMBLY

(75) Inventor: Jian-Hui Li, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 116 days.

(21) Appl. No.: 13/049,984

(22) Filed: Mar. 17, 2011

(65) Prior Publication Data

US 2012/0155686 A1 Jun. 21, 2012

(30) Foreign Application Priority Data

Dec. 15, 2010 (CN) ..... 2010 1 0589743

(51) Int. Cl.
*H04R 23/00* (2006.01)

(52) U.S. Cl.
USPC ..... 381/337; 381/395; 381/345

(58) Field of Classification Search
USPC ..... 381/395, 345
See application file for complete search history.

(56) References Cited

U.S. PATENT DOCUMENTS

| | | | | |
|---|---|---|---|---|
| 3,812,301 | A * | 5/1974 | Lahti | 381/341 |
| 6,009,972 | A * | 1/2000 | Choi et al. | 181/155 |
| 6,292,573 | B1 * | 9/2001 | Zurek et al. | 381/386 |
| 7,525,794 | B2 * | 4/2009 | Kwong et al. | 361/679.15 |
| 2007/0160246 | A1 * | 7/2007 | Vollmer | 381/336 |
| 2009/0010479 | A1 * | 1/2009 | Chen | 381/395 |
| 2011/0216933 | A1 * | 9/2011 | Lan | 381/386 |
| 2011/0235847 | A1 * | 9/2011 | Bhutani et al. | 381/395 |
| 2012/0063626 | A1 * | 3/2012 | Peng | 381/345 |

* cited by examiner

*Primary Examiner* — Curtis Kuntz
*Assistant Examiner* — Thomas Maung
(74) *Attorney, Agent, or Firm* — Altis Law Group, Inc.

(57) ABSTRACT

A loudspeaker assembly includes a first shell, a second shell, and a loudspeaker embedded in the first shell. Together the first shell and the second shell enclose a sound chamber. At least one of the first shell and the second shell can be folded to adjust the size of the sound chamber.

16 Claims, 6 Drawing Sheets

LOUDSPEAKER ASSEMBLY

BACKGROUND

1. Technical Field

The present disclosure generally relates to loudspeaker assemblies, and particularly, to a loudspeaker assembly including a size-adjustable sound chamber.

2. Description of Related Art

Generally, sound generated by sound source devices such as computers and DVD players needs to be amplified or improved in sound quality through a loudspeaker assembly. A typical loudspeaker assembly includes a loudspeaker and a shell, the loudspeaker and the shell enclose a sound chamber together. For improving the bass performance of the loudspeaker assembly, the sound chamber is usually large. Thus, the loudspeaker assembly takes up much space and is inconvenient to carry.

Therefore, there is a room for improvement within the art.

BRIEF DESCRIPTION OF THE DRAWINGS

Many aspects of the loudspeaker assembly can be better understood with reference to the following drawings. The components in the drawings are not necessarily to scale, the emphasis instead being placed upon clearly illustrating the loudspeaker assembly. Moreover, in the drawings, like reference numerals designate corresponding parts out the several views.

DETAILED DESCRIPTION

Figure 1:
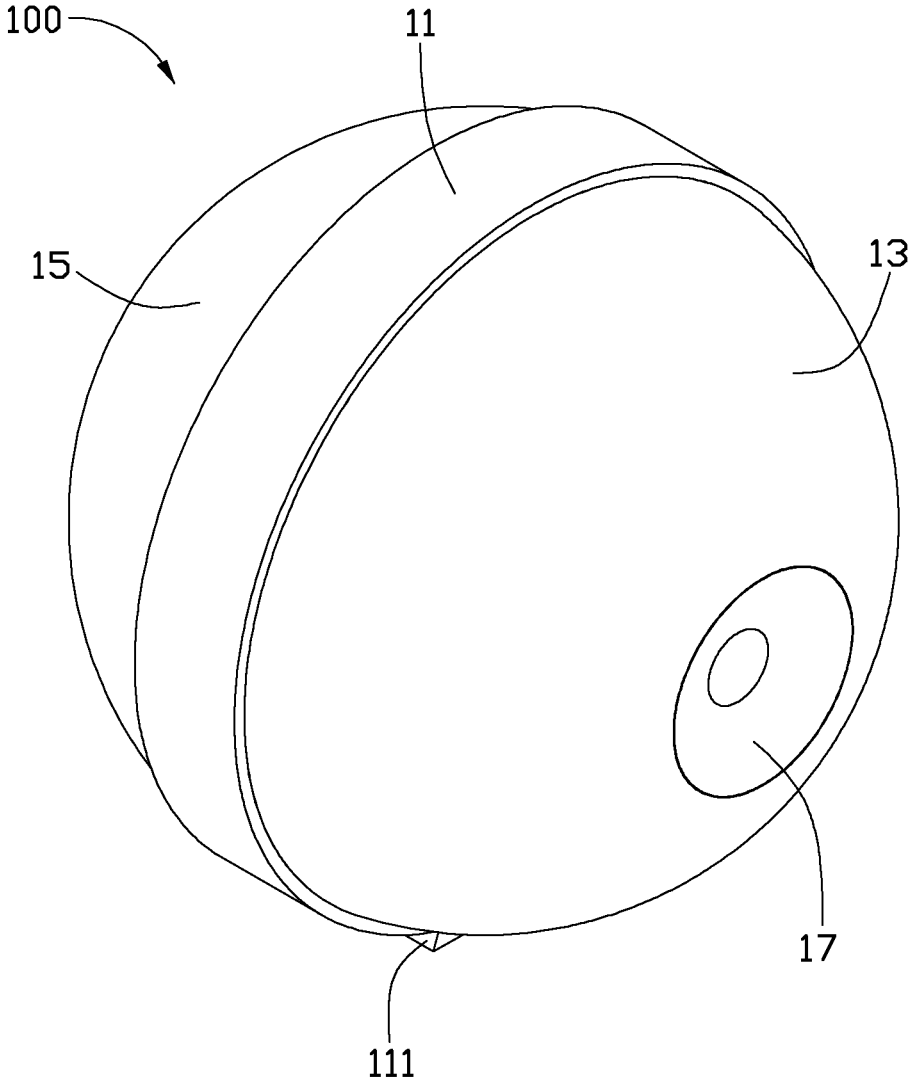
FIG. 1 is a schematic view of a loudspeaker assembly in an unfolded state, according to a first exemplary embodiment of the present disclosure.
Figure 2:
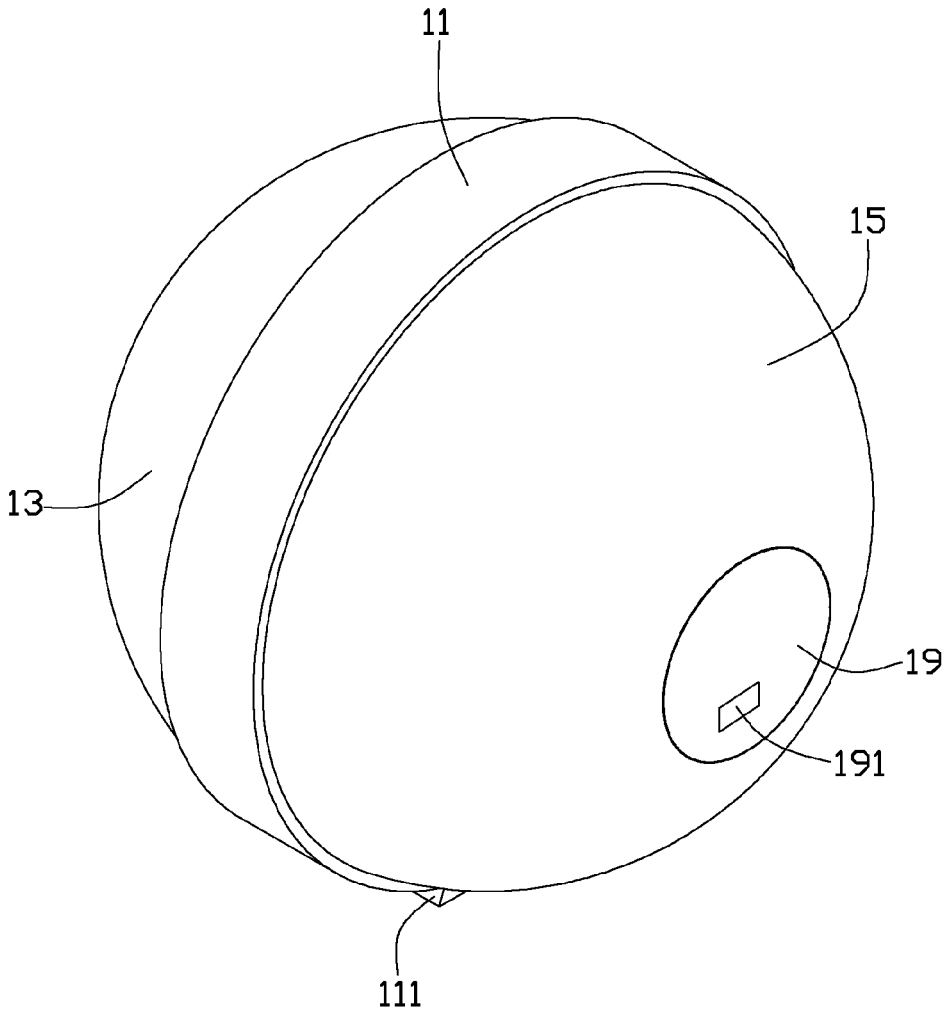
FIG. 2 is similar to FIG. 1, shown from another angle.

Referring to FIG. 1 and FIG. 2, a loudspeaker assembly 100 according to a first exemplary embodiment of the present disclosure, includes a connection element 11, a first shell 13, a second shell 15 opposite to the first shell 13, a loudspeaker 17 embedded in the first shell 13, and a circuit assembly 19 embedded in the second shell 15. The first shell 13 and the second shell 15 are hermetically connected together by the connection element 11. Together the first shell 13, the second shell 15, and the connection element 11 enclose a sound chamber. The circuit assembly 19 includes circuits required by the loudspeaker assembly 100 for normal operation, and is electronically connected to the loudspeaker 17. A port 191 is located on the circuit assembly 19. The loudspeaker assembly 100 may be electronically connected to sound source devices such as computers, DVD players through the port 191.

In this exemplary embodiment, the connection element 11 is roughly annular and includes a support block 111. The loudspeaker assembly 100 may stand steadily on a planar surface through the support block 111.

The first shell 13 and the second shell 15 may be made of flexible rubber, flexible plastic, flexible wood, or flexible paper. In this exemplary embodiment, the first shell 13 and the second shell 15 are each roughly hemispherical, and together define and enclose a sound chamber (not shown) of the loudspeaker assembly 100.

Figure 3:
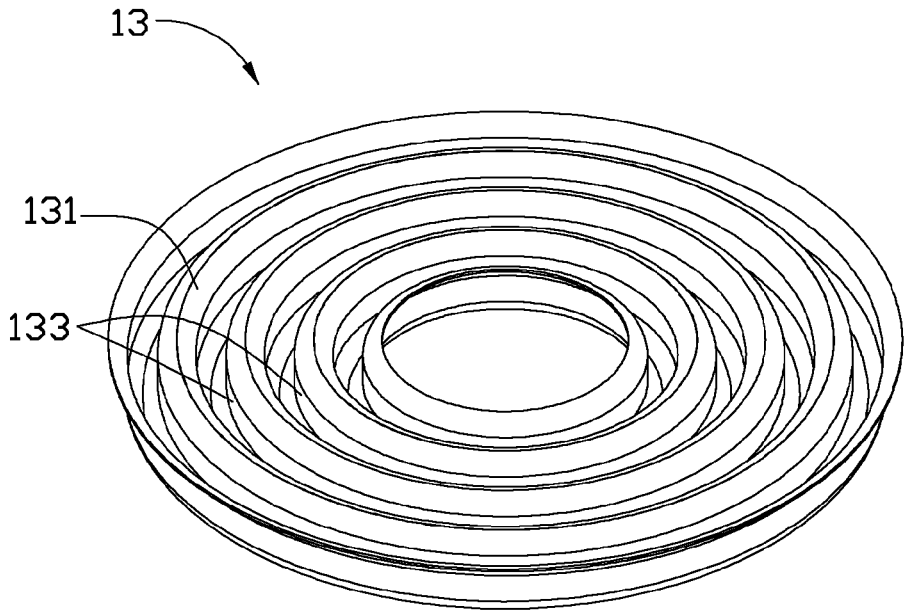
FIG. 3 is a schematic view of a first shell shown in FIG. 1, in a folded state.
Figure 4:
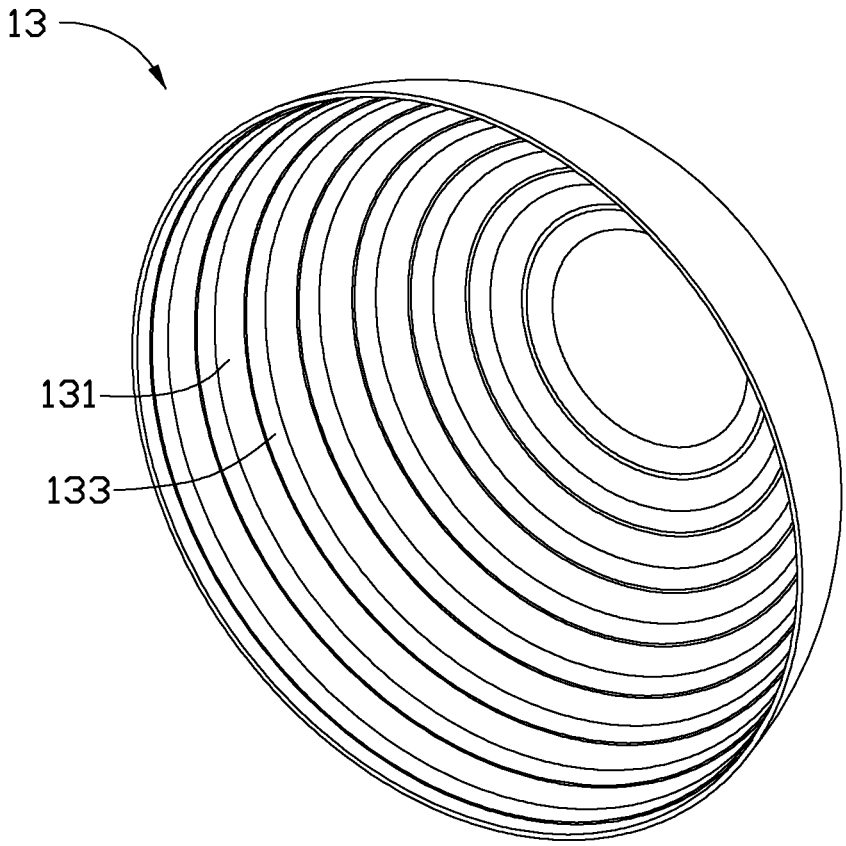
FIG. 4 is a schematic view of the first shell shown in FIG. 1, in an unfolded state.

Referring to FIG. 3 and FIG. 4, the first shell 13 includes a plurality of concentric deformation portions 131, and a plurality of concentric spacing portions 133. Each spacing portion 133 is located between two adjacent deformation portions 131. The spacing portions 133 are thicker than the deformation portions 131, allowing the deformation portions 131 to more easily fold than the spacing portions 133. When the first shell 13 is pressed by users, the deformation portions 131 are folded, and every two adjacent spacing portions 133 located at sides of a folded deformation portion 131 become parallel to each other. Every two adjacent spacing portions 133 and a deformation portion 131 located between the two adjacent spacing portions 133 together constitute an annular protrusion (not labeled). The folded first shell 13 is shown in FIG. 3. The configuration of the second shell 15 is the same as the configuration of the first shell 13, and so is not detailed here.

Figure 5:
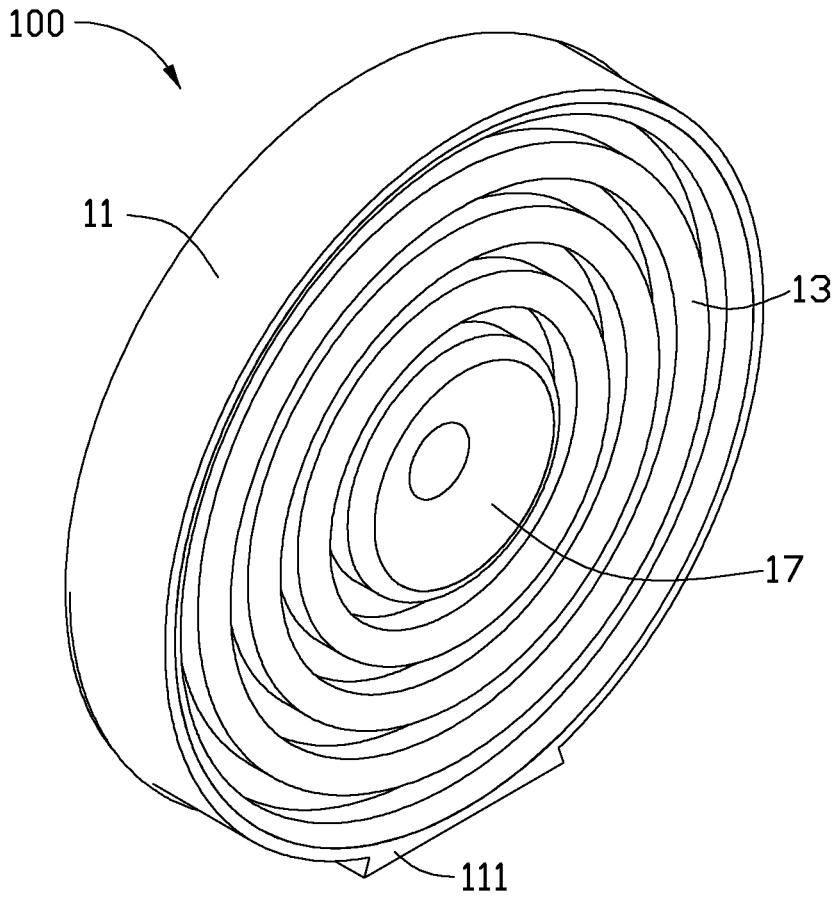
FIG. 5 is a schematic view of the loudspeaker assembly shown in FIG. 1, in a folded state.

Referring to FIG. 5, when not in use, a user can press the first shell 13 and the second shell 15, or press the loudspeaker 17 and the circuit assembly 19, and the first shell 13 and the second shell 15 are folded and received in the connection element 11. When there is a need to use the loudspeaker assembly 100, the loudspeaker 17 and the circuit assembly 19 are pulled away from the connection element 11, and the first shell 13 and the second shell 15 are restored to hemispherical shape as shown in FIG. 1. According to different requirements for bass performance, users may only fold one of the first shell 13 and the second shell 15.

As detailed above, the loudspeaker assembly 100 includes a foldable first shell 13 and a foldable second shell 15, which together define and enclose a sound chamber. According to different requirements for bass performance, users may fold one of the first shell 13 and the second shell 15 to adjust the size of the sound chamber. For enhanced portability, the first shell 13 and the second shell 15 can be folded together, and the loudspeaker assembly 100 is convenient to carry.

Figure 6:
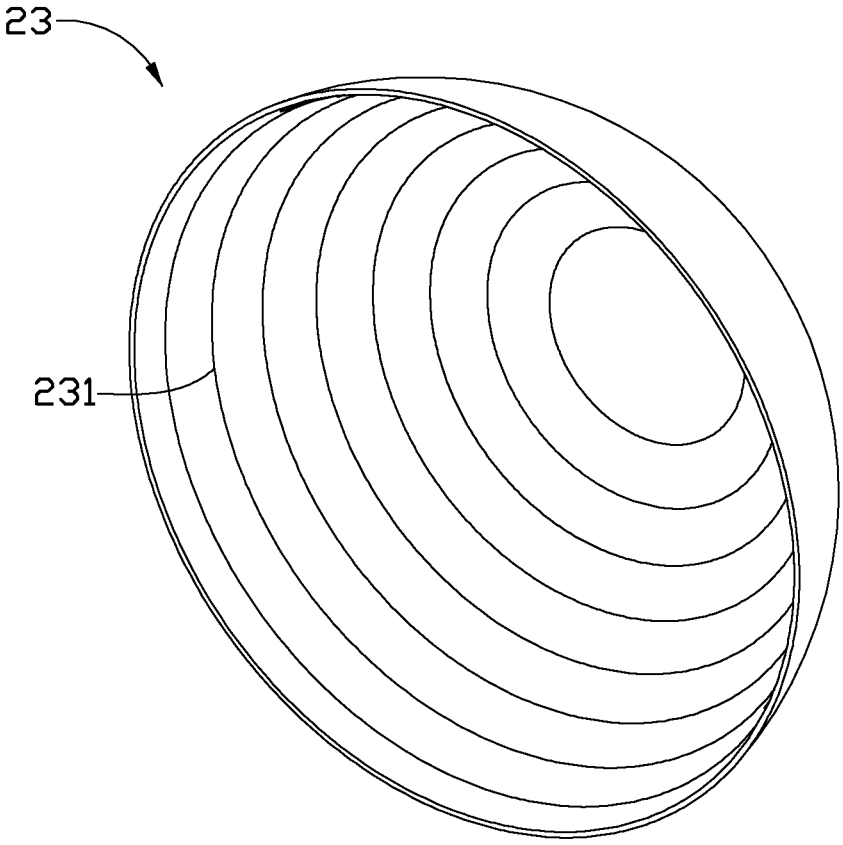
FIG. 6 is a schematic view of a first shell of a loudspeaker assembly in an unfolded state, according to a second exemplary embodiment of the present disclosure.

Referring to FIG. 6, a loudspeaker assembly according to a second exemplary embodiment of the present disclosure, is similar to the above-described loudspeaker assembly 100, but differing in that a plurality of concentric annular creases 231 are formed on an inner surface of a first shell 23. When the first shell 23 is pressed, the first shell 23 is folded along the creases 231. A second shell (not shown) of the loudspeaker assembly according to the second exemplary embodiment is the same as the first shell 23.

In an alternative exemplary embodiment, the connection element 11 may be omitted, and the first shell 13 is hermetically directly connected to the second shell 15. The first shell 13 and the second shell 15 enclose a sound chamber together.

In another alternative exemplary embodiment, the loudspeaker 17 is hermetically connected to the first shell 13 and the second shell 15. Together the first shell 13, the second shell 15, and the loudspeaker 17 enclose a sound chamber.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A loudspeaker assembly, comprising:

a first shell comprising a plurality of concentric deformation portions and a plurality of concentric spacing portions, each spacing portion located between two adjacent deformation portions;

a second shell; and a loudspeaker embedded in the first shell;

wherein together the first shell and the second shell enclose a sound chamber; the first shell can be folded to adjust the size of the sound chamber; when the first shell is unfolded, the plurality of deformation portions and the plurality of spacing portions are parallel and together form a smooth hemisphere; when the first shell is folded to disk shape, every two adjacent spacing portions are parallel and face each other, and the every two adjacent spacing portions and one of the plurality of deformation portions are located between the two adjacent spacing portions together constituting an annular protrusion, all of the annular protrusion are concentric, parallel and together constitute the disk shaped first shell.

2. The loudspeaker assembly as claimed in claim 1, wherein the first shell and the second shell are made of flexible rubber, flexible plastic, flexible wood, or flexible paper.

3. The loudspeaker assembly as claimed in claim 1, wherein the spacing portion is thicker than the deformation portion.

4. The loudspeaker assembly as claimed in claim 3, wherein the configuration of the second shell is the same as the configuration of the first shell.

5. The loudspeaker assembly as claimed in claim 1, wherein a plurality of creases are formed on an inner surface of the second shell; when the second shell is pressed, the second shell folds along the creases.

6. The loudspeaker assembly as claimed in claim 3, wherein the loudspeaker further comprises a connection element, the first shell and the second shell are hermetically connected together by the connection element.

7. The loudspeaker assembly as claimed in claim 6, wherein the first shell and the second shell can be folded and completely received in the connection element.

8. The loudspeaker assembly as claimed in claim 7, wherein the loudspeaker further comprises a circuit assembly electronically connected to the loudspeaker.

9. The loudspeaker assembly as claimed in claim 8, wherein the circuit assembly comprises a port, the loudspeaker assembly can be electronically connected to a sound source device through the port.

10. A loudspeaker assembly, comprising:

a first shell comprising a plurality of concentric deformation portions and a plurality of concentric spacing portions, each spacing portion located between two adjacent deformation portions;

a second shell; and a loudspeaker;

wherein together the first shell, the second shell and the loudspeaker enclose a sound chamber; the first shell can be folded to adjust the size of the sound chamber, when the first shell is unfolded, the plurality of deformation portions and the plurality of spacing portions are parallel and together form a smooth hemisphere; when the first shell is folded to disk shape, every two adjacent spacing portions are parallel and face each other, and the every two adjacent spacing portions and one of the plurality of deformation portions are located between the two adjacent spacing portions together constituting an annular protrusion, all of the annular protrusion are concentric, parallel and together constitute the disk shaped first shell.

11. The loudspeaker assembly as claimed in claim 10, wherein the spacing portion is thicker than the deformation portion.

12. The loudspeaker assembly as claimed in claim 11, wherein the configuration of the second shell is the same as the configuration of the first shell.

13. The loudspeaker assembly as claimed in claim 10, wherein a plurality of creases are formed on an inner surface of the second shell; when the second shell is pressed, the second shell folds along the creases.

14. The loudspeaker assembly as claimed in claim 11, wherein the loudspeaker further comprises a connection element, the first shell and the second shell are hermetically connected to the connection element.

15. The loudspeaker assembly as claimed in claim 14, wherein the first shell and the second shell can be folded and completely received in the connection element.

16. The loudspeaker assembly as claimed in claim 15, wherein the loudspeaker further comprises a circuit assembly electronically connected to the loudspeaker.

* * * * *